United States Patent [19]

Ogawa et al.

[11] Patent Number: 4,909,009

[45] Date of Patent: Mar. 20, 1990

[54] WALL PANEL

[75] Inventors: Kunihiro Ogawa, Nagoya; Shigeyuki Akihama, Chofu, both of Japan

[73] Assignee: Kajima Corporation, Japan

[21] Appl. No.: 351,079

[22] Filed: May 10, 1989

Related U.S. Application Data

[63] Continuation-in-part of Ser. No. 106,377, Oct. 6, 1987.

[30] Foreign Application Priority Data

Oct. 9, 1986 [JP] Japan ..... 61-155215

[51] Int. Cl.[4] ..... E04L 2/38

[52] U.S. Cl. ..... 52/475; 52/483; 52/602; 52/704; 52/787

[58] Field of Search ..... 52/704, 707, 602, 601, 52/600, 483, 475, 476, 477, 309.2, 787, 706, 506

[56] References Cited

U.S. PATENT DOCUMENTS

| | | | |
|---|---|---|---|
| 1,463,863 | 8/1923 | Zents | 52/707 |
| 1,563,593 | 12/1925 | Schall | 52/602 |
| 1,781,794 | 11/1930 | Tappan | 52/483 |
| 1,968,189 | 7/1934 | Bartels | 52/389 |
| 2,294,139 | 8/1942 | Strong | 52/602 |
| 2,584,626 | 2/1952 | Sherron | 52/309.2 |
| 3,066,448 | 12/1962 | Pinter | 52/483 |
| 3,248,836 | 5/1966 | Monk | 52/600 |
| 3,736,715 | 6/1973 | Krumwiede | 52/601 |
| 4,027,711 | 6/1977 | Tummarello | 52/707 |
| 4,045,933 | 9/1977 | Grillo | 52/483 |
| 4,700,518 | 10/1987 | Akihama | 52/600 |

FOREIGN PATENT DOCUMENTS

| | | | |
|---|---|---|---|
| 562250 | 6/1944 | United Kingdom | 52/706 |

*Primary Examiner*—John E. Murtagh

*Attorney, Agent, or Firm*—James H. Tilberry

[57] ABSTRACT

A lightweight wall panel for a building comprises a thin, flat, flexible panel body, a plurality of thin rib portions formed on one surface of the panel body at least at peripheral edges thereof, a plurality of female threaded fasteners embedded in the rib portions, and a plurality of separate reinforcement channels secured to the panel body at least at the peripheral edges thereof by a plurality of male threaded fasteners each extending through one of the reinforcement channels and threadedly engaging the respective female fasteners. The rib portions are only sufficiently thick that the attachment devices can be embedded therein. The reinforcement channels, which can be made of a lightweight material without impairing their strength, stiffen the flexible panel, and bear most of the load, so that the entire wall panel is light in weight and has adequate strength to be used as a load-bearing structure.

4 Claims, 3 Drawing Sheets

WALL PANEL

This is a continuation-in-part of application Ser. No. 07/106,377, filed on Oct. 6, 1987 now abandoned.

BACKGROUND OF THE INVENTION

This invention relates to a lightweight load-bearing wall panel adapted to be either factory or on site pre-assembled before installation.

Generally, in known wall panels of the type described above, a panel body is reduced in thickness in order to minimize the weight, and reinforcement ribs are formed at peripheral edges of the panel body in order to add strength. These reinforcement ribs must be relatively thick in order to provide adequate strength. The resulting panel is excessively thick and tends to be easily cracked. According to this prior art, because of the excessive thickness of the reinforcement ribs, an adequately lightweight panel is difficult to achieve and is time consuming and expensive to produce.

SUMMARY OF THE INVENTION

It is therefore an object of the present invention to provide a flat, lightweight, and adequately strong wall panel which can be easily and inexpensively mounted as a load-bearing wall on frame members of a building.

According to the present invention, the wall panel comprises a thin, flat, flexible, lightweight panel body; a plurality of rib portions formed on one surface of the panel body at peripheral edges thereof which are only sufficiently thick to receive embedded therein attachment devices; a plurality of attachment devices embedded in the rib portions; and a plurality of separate lightweight, load-bearing reinforcement channels secured to the rib portions, at least at the peripheral edges of the panel body, by a plurality of male threaded fasteners each extending through one of the reinforcement channels and threadedly engaging a respective female threaded fastener.

With this arrangement, because the reinforcement channels are secured to the panel body by means of the threaded fasteners, the flexible wall panel is made rigid so that it can be mounted on the frame member of the building to serve in a load-bearing capacity. Because most of the load is borne by the reinforcement channels rather than the panel body, it is possible to minimize the weight of the panel body.

Further, because of the reinforcement channels, an adequate degree of strength of the entire wall panel can be guaranteed.

In addition, with the reinforcement channels secured firmly, the wall panel can be quickly and securely attached to the frame members of the building.

BRIEF DESCRIPTION OF THE DRAWINGS

The foregoing and other objects and features of the invention will become apparent from the following description of a preferred embodiment of the invention with reference to the accompanying drawings, in which.

DETAILED DESCRIPTION OF THE PREFERRED EMBODIMENT

Figure 1:
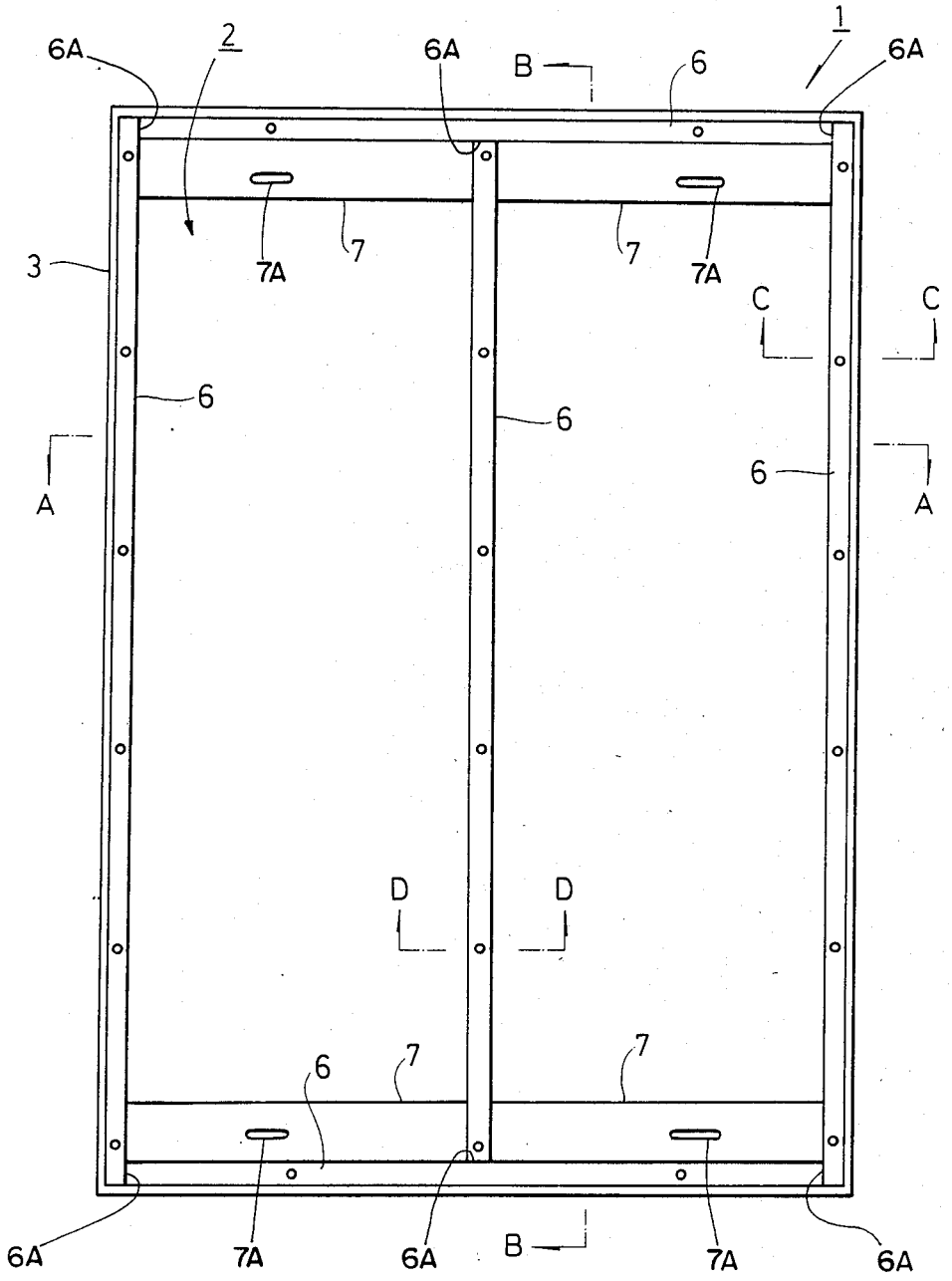
FIG. 1 is a rear view of a wall panel according to the present invention.
Figure 2:
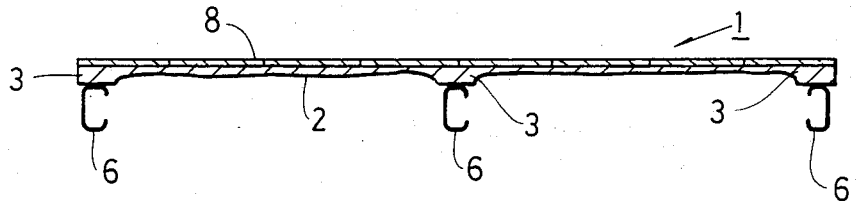
FIG. 2 is a cross-sectional view taken along line A—A of FIG. 1.

In this illustrated embodiment, the invention is used as a load-bearing external wall panel.

As shown in FIGS. 1 through 5, the external wall panel 1 comprises a thin, flat, flexible, lightweight panel body 2, and a plurality of thin rib portions 3 formed on a rear surface of the panel body 2 at least at peripheral edges thereof. The rib portions 3 are only sufficiently thick to receive embedded therein a plurality of female threaded fasteners 4. A plurality of separate reinforcement channels 6 are secured to the rib portions 3, at least at the peripheral edges of the panel body 2, by a plurality of male threaded fasteners 5 extending through the reinforcement channels 6 and threadedly engaging the female threaded fasteners 4. See FIGS. 4 and 5.

Figure 3:
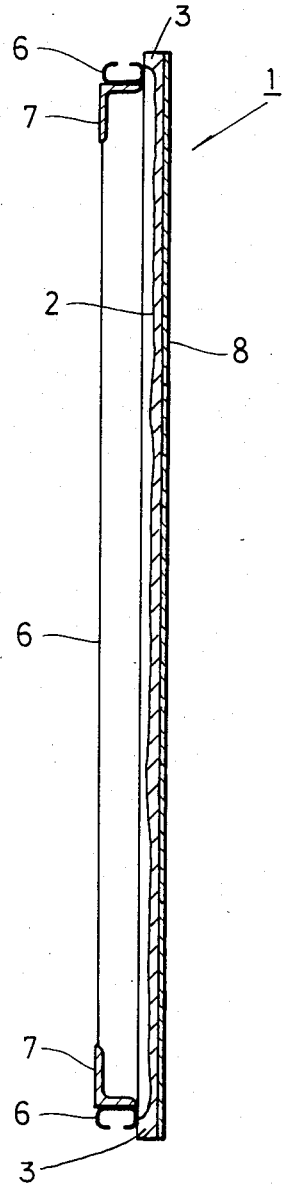
FIG. 3 is a cross-sectional view taken along line B—B of FIG. 1.

Panel attachment members 7, FIGS. 1 and 3, are rigidly secured to the horizontal channels 6 fastened to the top and bottom edges of the panel body 2. Members 7 may be secured to horizontal channels 6 by any conventional fastening means, such as by threaded fasteners. Elongated apertures 7A are formed in attachment members 7 for securing the wall panel to suitable fastening means integral with the frame members of a building.

A front surface, opposite to the surface on which the rib portions 3 are formed, of the panel body 2, is covered with at least one external tile 8. Alternatively, if the wall panel 1 according to the present invention is not used as the external wall panel, the front surface of the panel 1 may be covered with another finishing material.

The threaded axial holes 4*b* of attachment devices 4 are coplanar with the top surface of the rib portion 3 when the attachment device 4 is embedded in the rib portion 3. The rib portions 3 include an intermediate rib portion 3 extending between the upper and lower peripheral edges of the panel body 2 centrally and longitudinally of the panel body 2.

Figure 4:
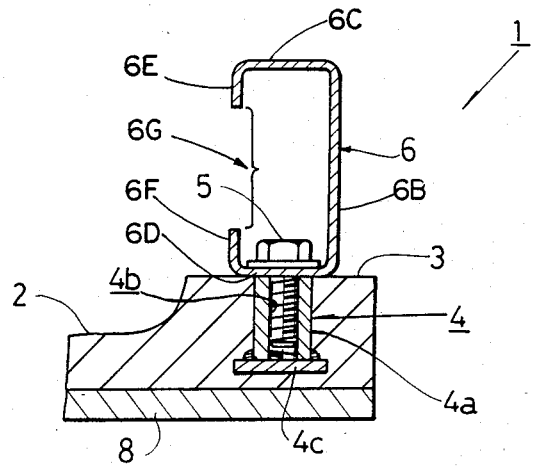
FIG. 4 is an enlarged cross-sectional view taken along line C—C of FIG. 1.
Figure 5:
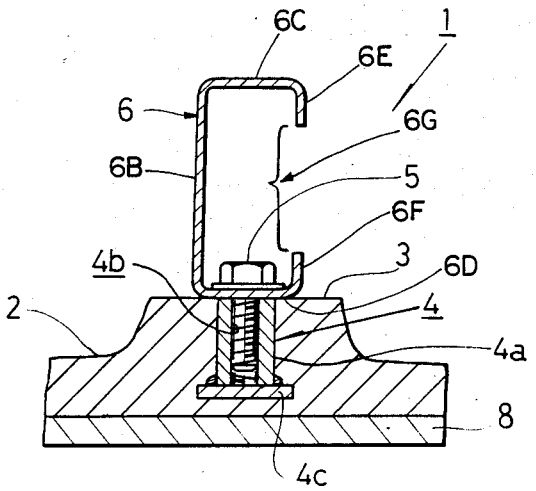
FIG. 5 is an enlarged cross-sectional view taken along line D—D of FIG. 1.

As shown in FIGS. 4 and 5, each threaded fastener 4 is an insert nut composed of a shank 4*a* in which the threaded axial hole 4*b* is formed, and a bottom plate 4*c* attached at a bottom end of the shank 4*a* and projecting from a peripheral surface of the shank 4*a*. The bottom plate 4*c* serves an an anchor to retain the attachment device 4 as the latter is embedded in the rib portion 3.

The reinforcement channels 6 are elongated structural members of a generally C-shaped cross section and are secured to the rib portions 3 at the peripheral edges of the panel body 2 and to the intermediate rib portion 3 extending between the upper and lower peripheral edges of the panel body 2. Each reinforcement channel 6 is fixedly secured to a respective one of the rib portions 3 by the male threaded fasteners 5, each extending threadedly into the threaded axial hole 4*b* of the respective female threaded fastening device 4.

For assembly of the external wall panel 1 constituted as described above, threaded fasteners 4 are embedded in the rib portions 3 of the panel body 2, and the external tile 8 is mounted on the front surface opposite to the surface on which the rib portions 3 are formed of the panel body 2. The reinforcement channels 6 are attached to the respective rib portions 3 of the panel body 2 by threaded fasteners 5, each extending threadedly into the threaded axial hole 4*b* of the respective threaded fasteners 4. Finally, the attachment members 7 are attached to the upper and lower horizontal channels 6 to complete the assembly of the external wall panel 1.

Although each reforcement channel 6 has a generally C-shaped cross section in the illustrated embodiment, it may have other shapes that enable the attachment of the channel 6 by the screws 5. However, with respect to maximum strength and lightness of weight, the most advantageous cross-sectional shape of the reinforcement channel 6 is shown in FIGS. 4 and 5.

Whereas the panel body 2 is thin and therefore lightweight and flexible, the securement of reinforcement channels 6 to the panel rib portions 3 renders the wall panel rigid and load bearing. This is so even through the reinforcement channels 6 are not overlapped but only make abutting contact one with the other, as shown at 6A of FIG. 1. Because the reinforcement channels 6 are not overlapped, pre-assembly is expedited.

The C-shape of the cross section of the reinforcement channel 6 is also selected to provide maximum strength while at the same time facilitating quick assembly. As best shown in FIGS. 4 and 5, the reinforcement channel 6 comprises a side surface member 6B, a front surface member 6C, and a back surface member 6D. Depending downwardly from front surface member C is a strength-reinforcing flange 6E. Projecting upwardly from back 6D is a strength-reinforcing flange 6F. The space 6G between the lower edge of flange 6E and the upper edge of flange 6F has been selected to permit sufficient space for male threaded fasteners 5 to be manually inserted within the interior of channel 6 for manual threaded engagement with female threaded fasteners 4. Space 6G is also selected to permit a socket wrench to enter the interior of the channel for final tightening of the threaded fasteners 4 and 5. Side surface member 6B is sized to provide an insulation space between the panel body and the building frame.

It will be clear to those skilled in the art that additional embodiments, modifications, and improvements may be made without departing from the intended scope of the invention as defined in the appended claims.

We claim:

1. A lightweight wall panel for mounting on a building frame member comprising: a lightweight, thin, planar surface, flexible, rectangular sheet member having front and back surfaces and top, bottom, and side edges, flat thin rib portions secured to the back surface of said member and parallel to the edges thereof, and being only of sufficient minimal thickness to receive and to embed female threaded fastener devices therein; means to render said flexible sheet rigid comprising separate lightweight monolithic C-shaped reinforcing channel members having side, front and back surfaces and fastening holes in the front surfaces; said C-shaped channel members being individually positioned on the said back surface of said panel in non-overlapping relationship; male threaded fasteners adapted to threadedly engage said female threaded fasteners through said channel member fastening holes; and attachment members mounted on said sheet member adjacent the upper and lower edges thereof adapted to be attached to frame members of said building.

2. The device of claim 1 wherein said C-shaped reinforcing channel members have side surfaces from which said front and back surfaces normally extend; and inwardly directed reinforcing flange portions extending normally from said front and back surfaces to define a longitudinal opening sufficient to manually insert said male threaded fasteners in said fastening holes and to manually threadedly engage said male threaded fasteners with said female threaded fasteners; said C-shaped reinforcing channel side surfaces being sized to define an insulation space between said sheet member and said building frame members.

3. The device of claim 1, wherein said C-shaped reinforcing channel members are separately threadedly fastened to said rib portions; a frame mounting member secured to the underside of the top channel member and a frame mounting member secured to the top side of the bottom channel member, said frame mounting members being adapted to be secured to fasteners on said building frame members.

4. The device of claim 2, wherein said C-shaped reinforcing channel members are separately threadedly fastened to said rib portions; a frame mounting member secured to the underside of the top channel member and a frame mounting member secured to the top side of the bottom channel member, said frame mounting members being adapted to be secured to fasteners on said building frame members.

* * * * *